US005483266A

United States Patent [19]

Nakamura

[11] Patent Number: 5,483,266

[45] Date of Patent: Jan. 9, 1996

[54] INK JET RECORDING APPARATUS WITH TWO STORAGE MODES

[75] Inventor: Fumiharu Nakamura, Yokohama, Japan

[73] Assignee: Canon Kabushiki Kaisha, Tokyo, Japan

[21] Appl. No.: 889,285

[22] Filed: May 28, 1992

[30] Foreign Application Priority Data

May 31, 1991 [JP] Japan ..... 3-156252

[51] Int. Cl.[6] ..... B41J 2/165

[52] U.S. Cl. ..... 347/23; 347/30; 347/31

[58] Field of Search ..... 346/140 R; 347/22, 347/19, 23, 28, 29, 30, 31

[56] References Cited

U.S. PATENT DOCUMENTS

| | | | |
|---|---|---|---|
| 3,925,789 | 12/1975 | Kashio | 347/23 |
| 4,313,124 | 1/1982 | Hara | 347/57 |
| 4,317,124 | 2/1982 | Shirato et al. | 347/89 X |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,543,589 | 9/1985 | Terasawa | 347/30 |
| 4,558,333 | 12/1985 | Sugitani et al. | 347/65 |
| 4,626,869 | 12/1986 | Piatt | 347/74 |
| 4,692,777 | 9/1987 | Hasumi | 347/23 |
| 4,723,129 | 2/1988 | Endo et al. | 347/56 |
| 4,740,796 | 4/1988 | Endo et al. | 347/56 |
| 4,970,527 | 11/1990 | Gatten | 347/23 |
| 4,999,643 | 3/1991 | Terasawa | 347/30 |
| 5,136,307 | 8/1992 | Uchida et al. | 347/104 X |
| 5,153,614 | 10/1992 | Yamaguchi et al. | 347/30 |

FOREIGN PATENT DOCUMENTS

| | | | |
|---|---|---|---|
| 54-145561 | 11/1979 | Japan | 347/23 |
| 59-123670 | 7/1984 | Japan . | |
| 59-138461 | 8/1984 | Japan . | |
| 60-071259 | 4/1985 | Japan . | |
| 60-151059 | 8/1985 | Japan . | |
| 3-293154 | 12/1991 | Japan . | |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An ink jet recording apparatus that records by causing ink to adhere to a recording medium includes a recording head with nozzles for ejecting ink and a cap member for covering and sealing the ink ejecting surface of the recording head and containing a porous body for retaining ink introduced into the cap member one of two ways, either by ejecting it from the nozzles or by using a suction pump communicating with the cap member. The recording apparatus has two storage modes, one of which is used for long-term storage, whereby a relatively large amount of ink is retained by the porous body, and the other of which is used for short-term storage, whereby a smaller amount of ink is retained by the porous body.

29 Claims, 7 Drawing Sheets

INK JET RECORDING APPARATUS WITH TWO STORAGE MODES

BACKGROUND OF THE INVENTION

1. Field of the Invention

The present invention relates to an ink jet recording apparatus which records by causing ink to adhere to a recording medium and, in particular, to an ink jet recording apparatus equipped with a mechanism which makes possible satisfactory recording by a recording means.

2. Description of the Related Art

A recording apparatus having the function of a printer, copying machine, facsimile apparatus or the like, or a recording apparatus used as the output device of a composite apparatus or a work station including a computer, word processor or the like, records images on a recording medium, such as paper or a thin plastic sheet (OHP or the like), in accordance with image information. There are various types of such recording apparatuses, which are classified according to the type of recording means they use, such as: an ink jet type, a wire dot type, a thermo-sensitive type, a thermal transfer type, a laser beam type, etc.

In a serial-type recording apparatus, in which a main scanning is performed perpendicular to the direction in which the recording medium is fed, image recording is effected on the recording medium, which has been set at a fixed recording position, by a recording means mounted on a carriage which moves along the recording medium. After recording one line of information, the recording medium is fed by a fixed amount (pitch feed). After that, the recording (i.e., the main scanning) of the next line is effected. By repeating this operation, image recording is performed over the entire recording medium. In a line-type recording apparatus, which records solely by sub-scanning, that is, feeding the recording medium in the feed direction, the recording medium is first set at a fixed recording position to record one line of information collectively, and then is fed by a fixed amount (pitch feed). Subsequently, the next line is recorded collectively. By repeating this operation, image recording is effected over the entire recording medium.

Both the serial and line-type recording apparatuses may use an ink-jet type recording system, in which recording is effected by ejecting ink from recording means (a recording head) onto the recording medium. This recording system has various advantages. For example, (a) the recording means can be made compact; (b) an image of a high level of resolution can be recorded at high speed; (c) the operating cost is relatively low since ordinary paper which has undergone no special processing can be used; (d) because it is a non-impact system, the noise level is relatively low; and (e) a color image can be easily recorded by using inks of various colors. Above all, this recording system is especially advantageous when used in a line-type recording apparatus, in which a large number of ejection nozzles are arranged in the paper-width dimension, since it allows recording at still higher speeds.

In particular, ink-jet type recording means (recording head), in which ink is ejected by utilizing heat energy, can be easily produced as a small-sized recording head having liquid passages (ejection nozzles) arranged at high density, by forming electro-thermal conversion members, electrodes, liquid passage walls, top plate, etc. on a substrate by semiconductor fabrication processes, such as etching, evaporation or sputtering.

The ink jet recording apparatus, described above, generally employs a recording head on which minute ejection nozzles are arranged, so that if the ink has become unsuitable for ejection or recording as a result of intrusion of bubbles, dust or the like into the interior of the ejection nozzles or an increase in the viscosity of the ink due to evaporation of some of the ink solvent, some portion of the ink near the ejection nozzles is discharged from the nozzles to refresh the ink, thereby eliminating the factor causing defective ejection and restoring the proper ejecting condition.

An ink-jet recording apparatus is equipped with a restoring mechanism for restoring proper ejection. Such a mechanism typically consists of a cap capable of covering the face of the recording head on which the ejection nozzles are formed (hereinafter referred to as the "nozzle surface") and a pump communicating with this cap and exerting a sucking force. There are two types of ejection restoring operations: in one, ink-ejection-energy generating elements inside the ejection nozzles are operated with the cap opposed to the nozzle surface of the head, thereby causing some ink to be discharged; in the other, some ink is forcibly sucked out from the nozzles by exerting a sucking force with the nozzle surface sealed by the cap pressed against it. In some cases, the head is held in a "capped" state when it is not being operated, thereby preventing evaporation of ink through the nozzle surface of the head, or clogging of ink due to thickening or clinging thereof.

In an ink jet recording system, a mechanism for restoring and a mechanism for maintaining a satisfactory ink ejecting condition of the recording head are essential.

U.S. Pat. No. 4,317,124 discloses an example of such a system, according to which the recording head is kept in a capped state when no recording is being performed, with the space defined by the cap and the head being filled with ink so as to keep the head moist, thereby preventing evaporation of ink through the nozzle surface of the recording head, etc. A problem with this mechanism is that the ink filling the above-mentioned space may leak as a result of expansion of the ink due to environmental changes.

Further, it should be noted that in some cases it is impossible to secure a sufficiently high level of reliability if maintenance of the head in a condition where recording is frequently performed (short-term storage) and maintenance thereof when the recording head is not used for a long period of time (long-term storage) are conducted in the same manner.

A means of overcoming this problem is described, for example, in Japanese Patent Laid-Open No. 60-151059, according to which only the capping is effected for a short-term storage. For long-term storage, the ink in the recording head is entirely discharged and the head is cleaned with cleaning liquid before storage. Accordingly, a dedicated storage section, feeding section, etc. for the cleaning liquid are necessary, so that the apparatus must have a very large size.

Further, if the ink in the recording head is entirely drawn out for long-term storage, it is necessary to re-fill the head with ink when recording is to be performed again. Moreover, such re-filling has to be conducted twice so as to flush any remaining cleaning liquid from the head, so that the consumption of ink increases, resulting in high operating costs.

Apart from these arrangements, a structure has been proposed in which a porous body is provided inside the cap. This porous body temporarily traps the discharged ink to provide a moistening effect.

The ink discharged from the recording head is sucked by a pump and collected in a discharged-ink sump. However, as a result of the above-described sucking operation, the porous body in the cap is in a squeezed condition, so that the amount of ink retained by the porous body is small, resulting in an insufficient moistening effect. Thus, in the prior-art relying upon a sucking operation, a sufficient evaporation suppressing effect for the portion of the ink near the ejection nozzles cannot be obtained.

Thus, with the various methods which have been proposed up to the present, it is impossible to effect restoring and maintenance of proper ejection easily and reliably with respect to both long-term and short-term storage.

SUMMARY OF THE INVENTION

After carefully examining the above technical problems, it was discovered that by making the moistening condition for long-term storage different from that for short-term storage, i.e., by keeping the space defined by the head and the cap wetter for long-term storage than for short-term storage, it is possible to maintain the head in a satisfactory condition with a simple construction.

The present invention has been made on the basis of the above discovery. It is an object of this invention to provide an ink jet recording apparatus in which the interior of the recording head and that of the cap can be kept in a high-humidity condition not only for a short period but also for a long period, thereby making it possible to maintain a stable ink ejecting condition for a long period of time.

In accordance with an aspect of the present invention, an ink jet recording apparatus comprises a recording head having a surface with an ejection nozzle for discharging ink, a cap member for contacting and sealing the surface of the recording head, wherein the cap member has disposed in the interior thereof a porous body for retaining ink, introducing means for introducing ink to the porous body for retention thereby, and control means for operating the introducing means to introduce ink to the porous member to increase the humidity in the interior of the cap member when the surface is sealed, wherein the control means operates the introducing meas in a first mode in which a first predetermined amount of ink is introduced to the porous body for storage of the apparatus for a non-recording period of a first duration, and in a second mode in which a second, smaller predetermined amount of ink is introduced to the porous member for storage of the apparatus for a non-recording period of a second, shorter duration.

In accordance with other aspects of the invention, the introducing means includes discharging means for discharging ink from the ejection nozzle to the porous body and suction means for sucking ink from the recording head through the nozzle and into the cap member for retention by the porous member.

DETAILED DESCRIPTION OF THE PREFERRED EMBODIMENTS

Figure 1:
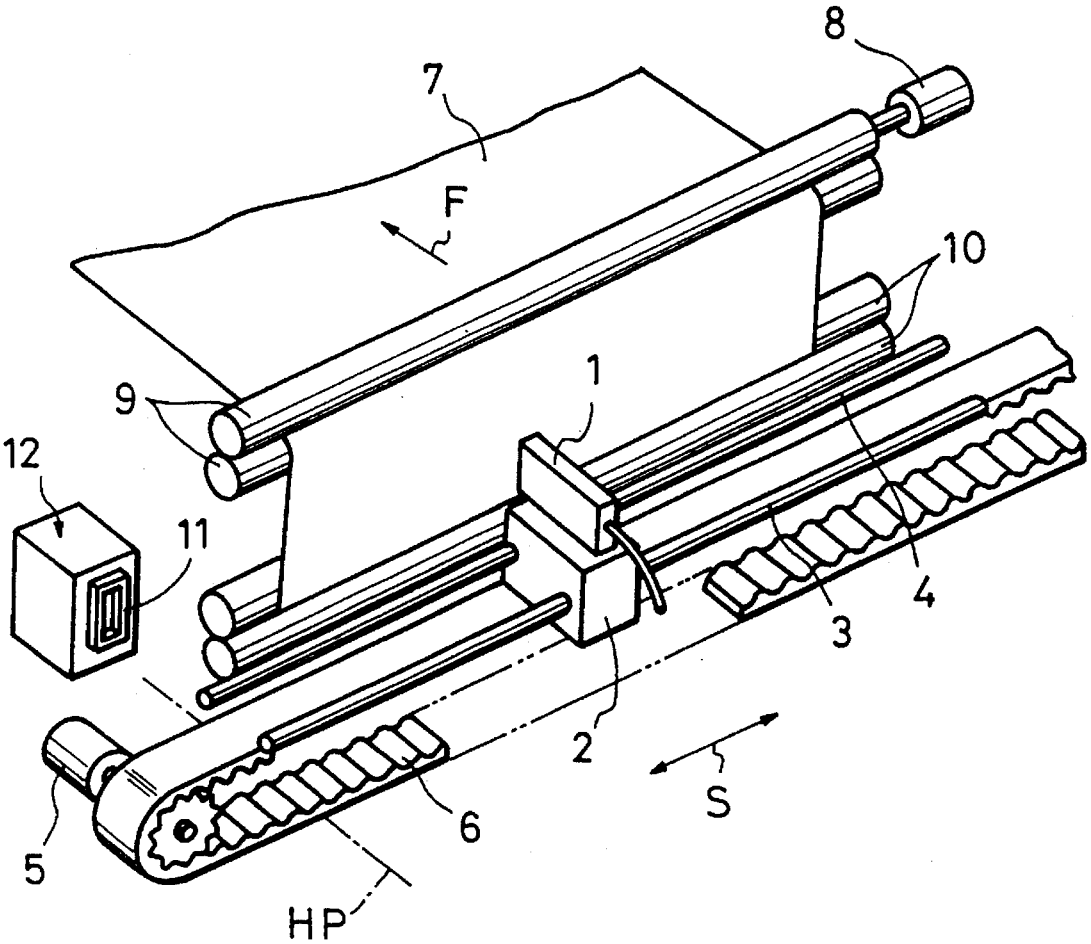
FIG. 1 is a schematic perspective view showing the construction of an essential part of an ink jet recording apparatus to which the present invention can be suitably applied.

Embodiments of the present invention will now be described with reference to the accompanying drawings. FIG. 1 is a schematic perspective view showing the construction of an essential part of an ink jet recording apparatus to which the present invention can be suitably applied. In the drawing, recording means (a recording head) 1 is mounted on a carriage 2, which is slidably supported by guide rails 3 and 4 in such a manner as to be guided thereon in the directions indicated by the arrow S. The carriage 2 is driven to reciprocate by a carriage motor 5 through a timing belt 6. A recording medium 7 in the form of a sheet, which consists of paper, a thin plastic sheet or the like, is fed along a fixed path and with a fixed timing and at a fixed speed in the direction indicated by the arrow F by a pair of feeding rollers 9 driven by a feeding motor (a paper feed motor) 8, and a pair of retaining rollers 10.

While the recording medium 7 is being held flat at a recording position where it faces the nozzle surface of the recording head 1, the carriage 2 is moved and the recording head 1 ejects ink onto the recording medium 7 as it performs a main scanning over the same, thereby effecting recording thereon. When the recording of one line of information has been terminated, the recording medium 7 is pitch-fed by a fixed amount corresponding to the recording width in the direction of the arrow F to become ready for recording on the next area. The recording head 1 is generally mounted on the carriage 2 in such a manner as to be replaceable. In some cases, however, it may be integrated with the carriage 2. Various types of recording heads can be used as the recording head 1. For example, it may be of a head cartridge type in which it is integrated with an ink tank, or a type which is formed separate from the ink tank and connected thereto through an ink supply tube or the like.

Arranged at a fixed position which is within the range of movement of the carriage 2 and outside the recording area (for example, a home position HP) is an ejection restoring device (a device for maintaining a proper ejection function) 12 having a cap 11 for sealing (capping) the nozzle surface of the recording head 1. By sealing the ejection nozzles with the cap 11, the ejection restoring device 12 prevents the ink from thickening or clinging as a result of drying, and sucks some ink from the nozzles by operating a suction pump (not shown) so as to remove any clinging ink, dust, such as paper powder, bubbles or the like from the ejection nozzles, thereby restoring the head to a proper ejecting condition.

The recording head 1 is an ink jet recording means which ejects ink by utilizing heat energy. Each of its ink passages, arranged in correspondence with the nozzles, is equipped with an electrothermal conversion element. Further, the recording means 1 ejects ink from the ejection nozzles by utilizing pressure changes due to growth and contraction of bubbles as a result of film boiling caused by the heat energy applied by the electrothermal conversion elements, thereby effecting recording.

Figure 2:
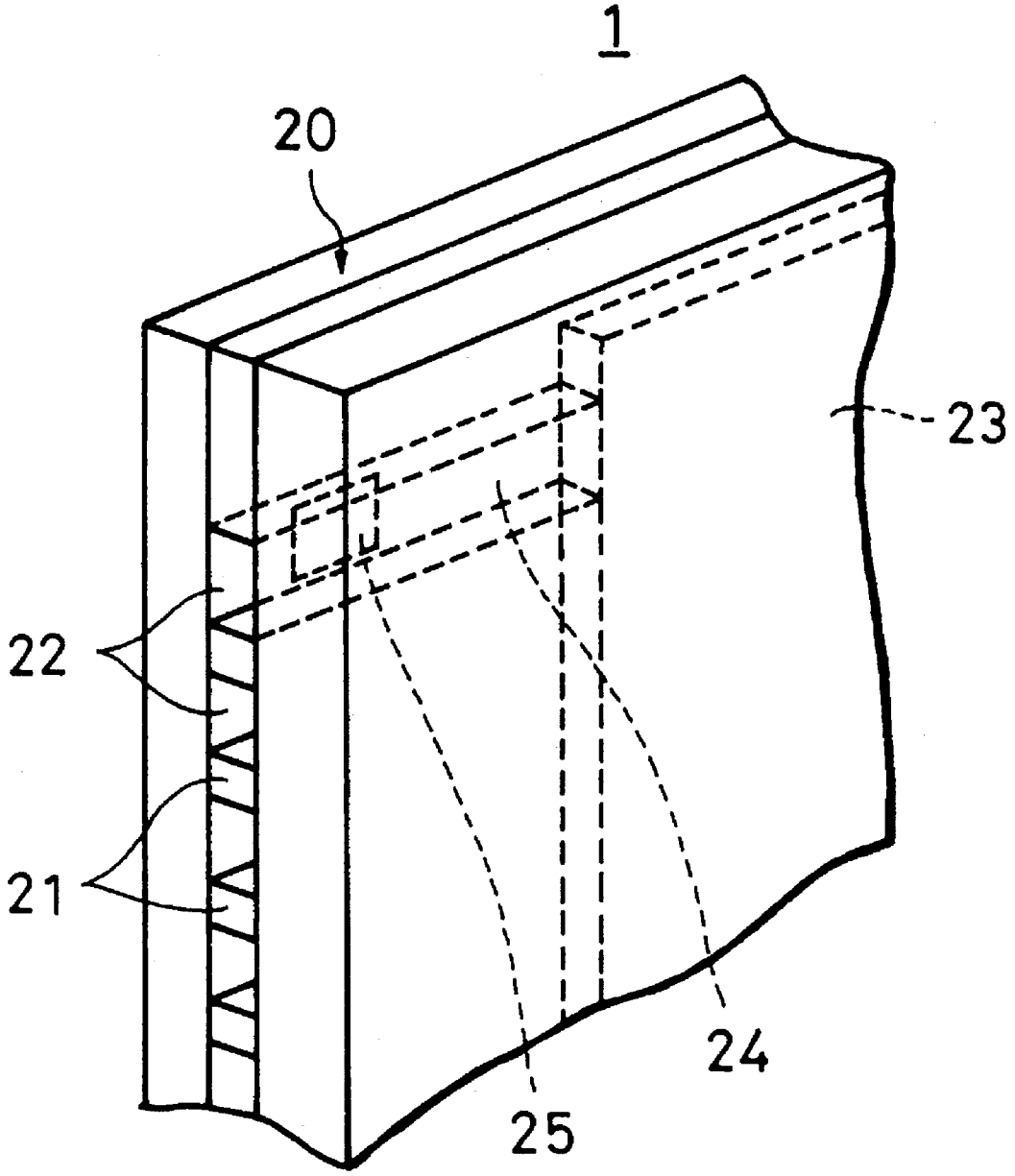
FIG. 2 is a schematic perspective view showing the structure of the ink ejecting section of the recording apparatus shown in FIG. 1.

FIG. 2 is a partial perspective view schematically showing the construction of an ink ejecting section 20 of the recording head 1. As shown in the drawing, a nozzle surface 21, which is opposed to and spaced apart from the recording medium 7 by a fixed distance (for example, approximately 0.5 to 2.0 mm), has a plurality of ejection nozzles 22 which are arranged at fixed intervals. Each nozzle 22 communicates with a common liquid chamber 23 through a liquid passage 24, on the wall of which is arranged an electrothermal conversion element (a heat generating resistor or the like) 25. In the example shown, the recording head 1 is mounted on the carriage 2 such that the ejection nozzles 22 are arranged perpendicular to the scanning direction of the carriage 2. In the recording head 1, constructed as described above, an image recording signal or an ejection signal causes the corresponding electrothermal conversion element 25 to be driven (energized), thereby causing film boiling in the portion of ink in the corresponding liquid passage 24. The pressure thereby generated causes the corresponding ejecting nozzle 2 to eject ink.

Figure 3:
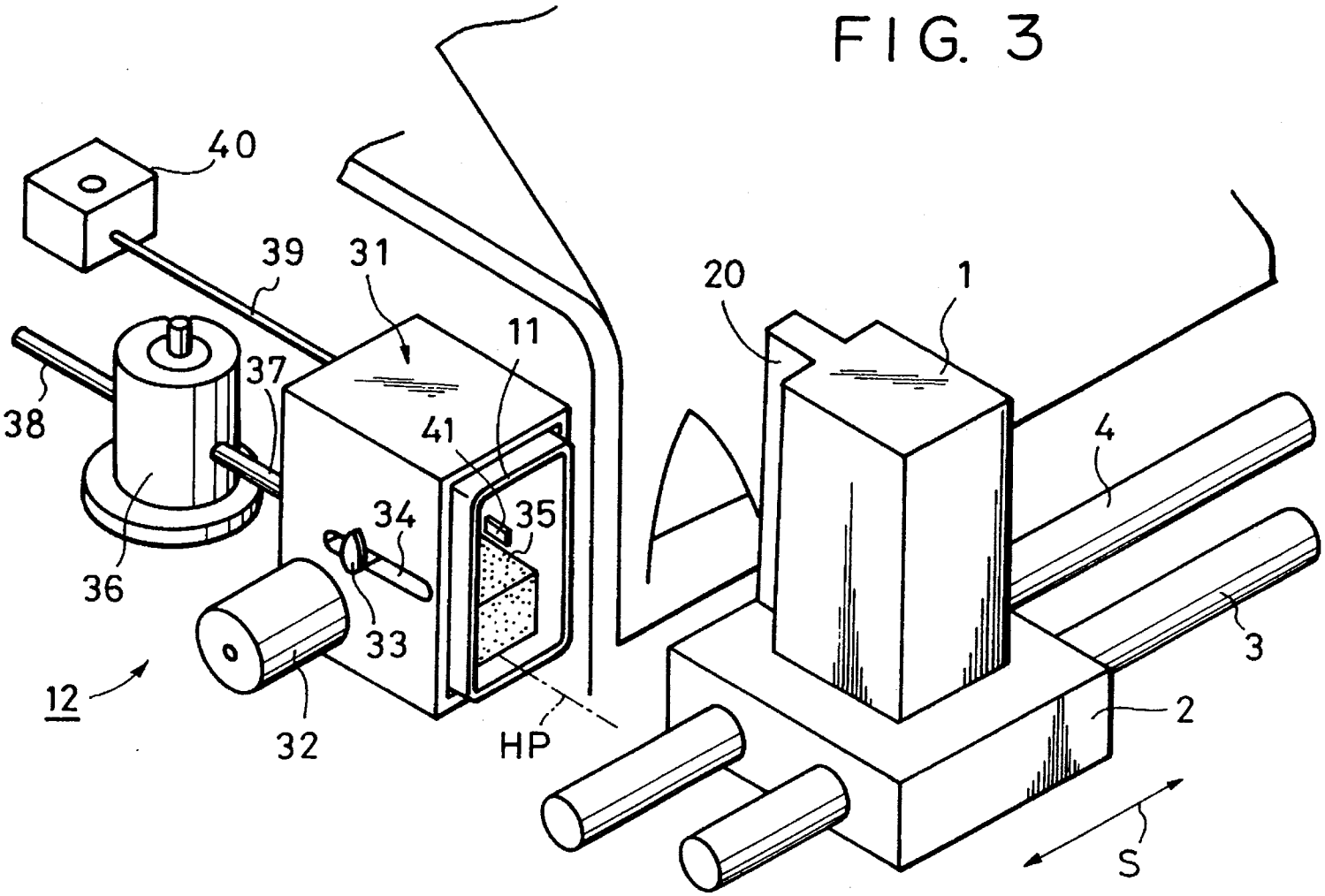
FIG. 3 is a schematic perspective view showing the construction of an essential part of an ink jet recording apparatus according to an embodiment of the present invention.

FIG. 3 is a schematic perspective view showing the construction of the ejection restoring device 12 of an ink jet recording apparatus according to an embodiment of the present invention. In the drawing, the carriage 2, on which the ink jet recording head 1 is mounted, causes ejected droplets of ink to adhere to the opposed recording medium 7 as the carriage 2 is driven by the carriage motor 5 to move on the guide rails 3 and 4 in the direction indicated by the arrow S, thereby effecting recording. When terminating recording or performing a restoring operation, the recording head 1 is moved to a position where it faces the ejection restoring device 12 (which is usually situated at the home position HP), and a cap motor 32 drives the cap member 11 in a cap unit 31 so as to cause the cap member 11 to advance, thereby sealing (capping) the nozzle surface 21 (i.e., the ejection nozzles 22) of the recording head 1, and retract (as shown). In the example shown, the cap 11 is supported by a guide mechanism composed of a guide shaft 33 and guide grooves 34, in such a manner that it can move forwards and backwards with respect to the cap unit 31.

As shown in FIG. 3, lodged in the interior of the cap 11 is a porous body 35 having an excellent ink retaining capacity. When an ejection restoring sequence is started, an ejection restoring operation as described below is conducted. A restoring pump (a suction pump) 36 serving as a negative pressure source is driven to generate a negative pressure, which is introduced into the interior of the cap 11 through a pump pipe 37, with the ejection nozzles 22 capped. The pump pipe 37 is connected to an opening in the rear section of the porous body 35 inside the cap 11. Thus, when the restoring pump 36 is driven to generate a negative pressure in the sealed space between the cap 11 and the nozzle surface 21, some ink is forcibly sucked out of the ejection nozzles 22 to the interior of the cap 11. The ink thus sucked out is conveyed through the porous body 35, the pump pipe 37 and the suction pump 36, and is collected through a waste ink pipe 38.

The cap 11 is connected to one end of an atmospheric release pipe 39, which communicates with the interior of the cap 11, and an atmospheric release valve 40 is connected to the other end of the atmospheric release pipe 39. By opening the atmospheric release valve 40, the interior of the cap 11 can communicate with the ambient atmosphere. At the time when the above-mentioned ejection restoring sequence is started, the atmospheric release valve 40 is in the closed position, the valve remaining closed in the initial stage of the ink sucking operation. After a fixed period of time has elapsed since the start of the ink sucking operation by the pump 36, the atmospheric release valve 40 is opened, thereby securing the normal meniscus condition for the ejection nozzles 22 of the recording head 1 and collecting the remaining ink inside the cap 11.

Figure 4:
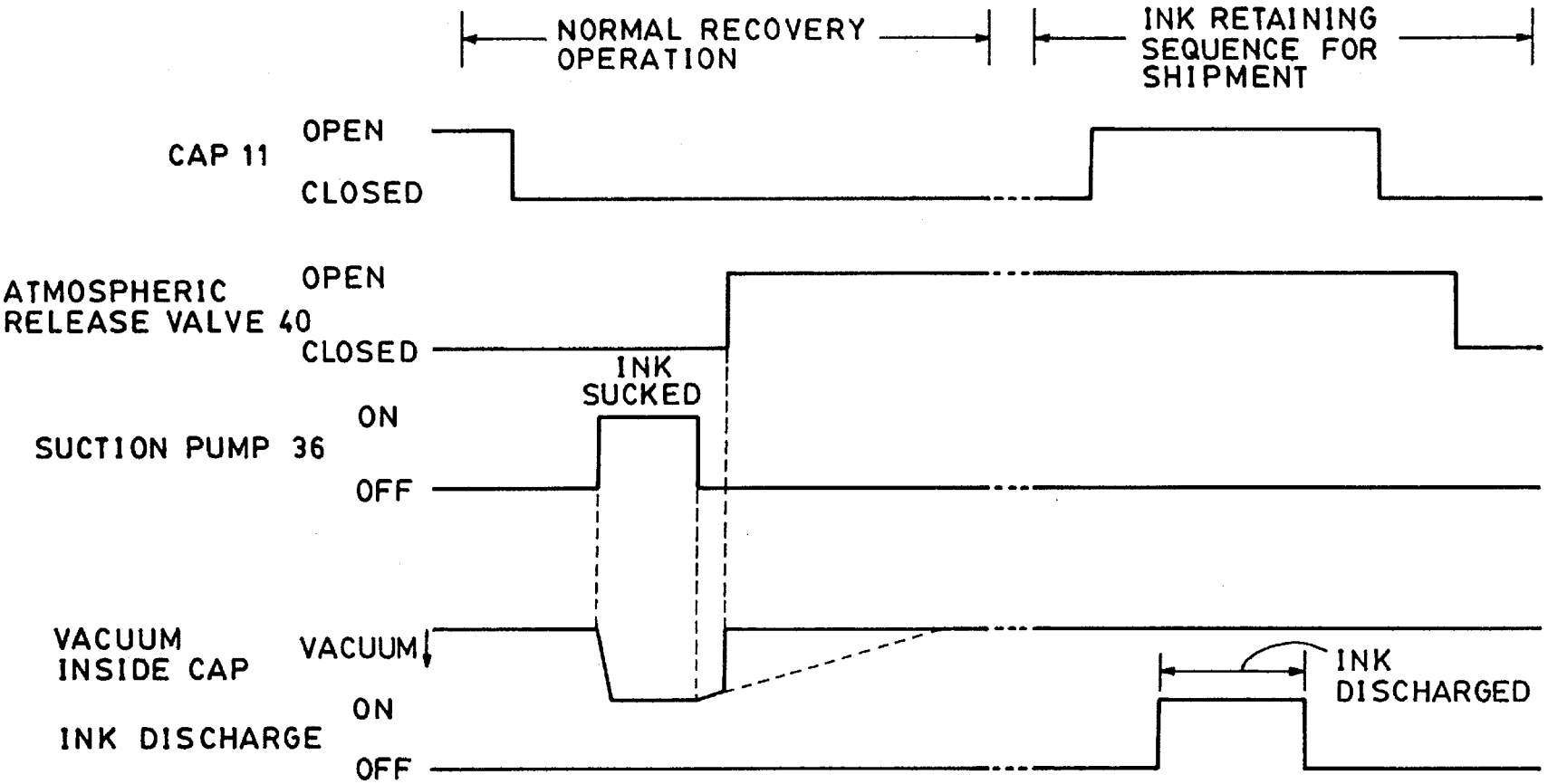
FIG. 4 is a timing chart showing the ink retaining sequence for shipment of an ink jet recording apparatus according to an embodiment of the present invention.

With the ink jet recording apparatus of the first embodiment of the present invention, shipment of the product (i.e., the recording apparatus), which corresponds to a long-term storage period, is conducted by starting an ink retaining sequence for shipment illustrated by the timing chart in FIG. 4. The ink retaining sequence for shipment is started after a normal recovery operation, that is, closing the cap 11, sucking ink by using the pump 36 and releasing the atmospheric release valve 40, as described above. The cap 11 is then driven by the cap motor 32 and moves backwards from the capping position, where it has thus far been in close contact with the nozzle surface 21 of the head, until it stops at a position spaced apart from the nozzle surface 21.

Then, by driving (energizing) the drive elements (the electrothermal conversion elements) 25 in the ejecting nozzles 22, some ink is discharged from the nozzles 22 to the interior of the cap 11 and thereby is introduced to the porous body 35 in the cap 11 to retain a fixed amount of ink in the porous body 35. The amount of ink discharged in this first mode, that is, in the case of long-term storage, is determined such that the porous body 35 retains approximately 80% of its maximum ink retaining capacity. After the ejection of ink has been completed, the cap motor 32 is driven to move the cap 11 toward the recording head 1, until the cap 11 seals (caps) the ejection nozzles 22 again. Subsequently, the atmospheric release valve 40 is closed, thereby completing the ink retaining sequence for shipment.

Figure 5:
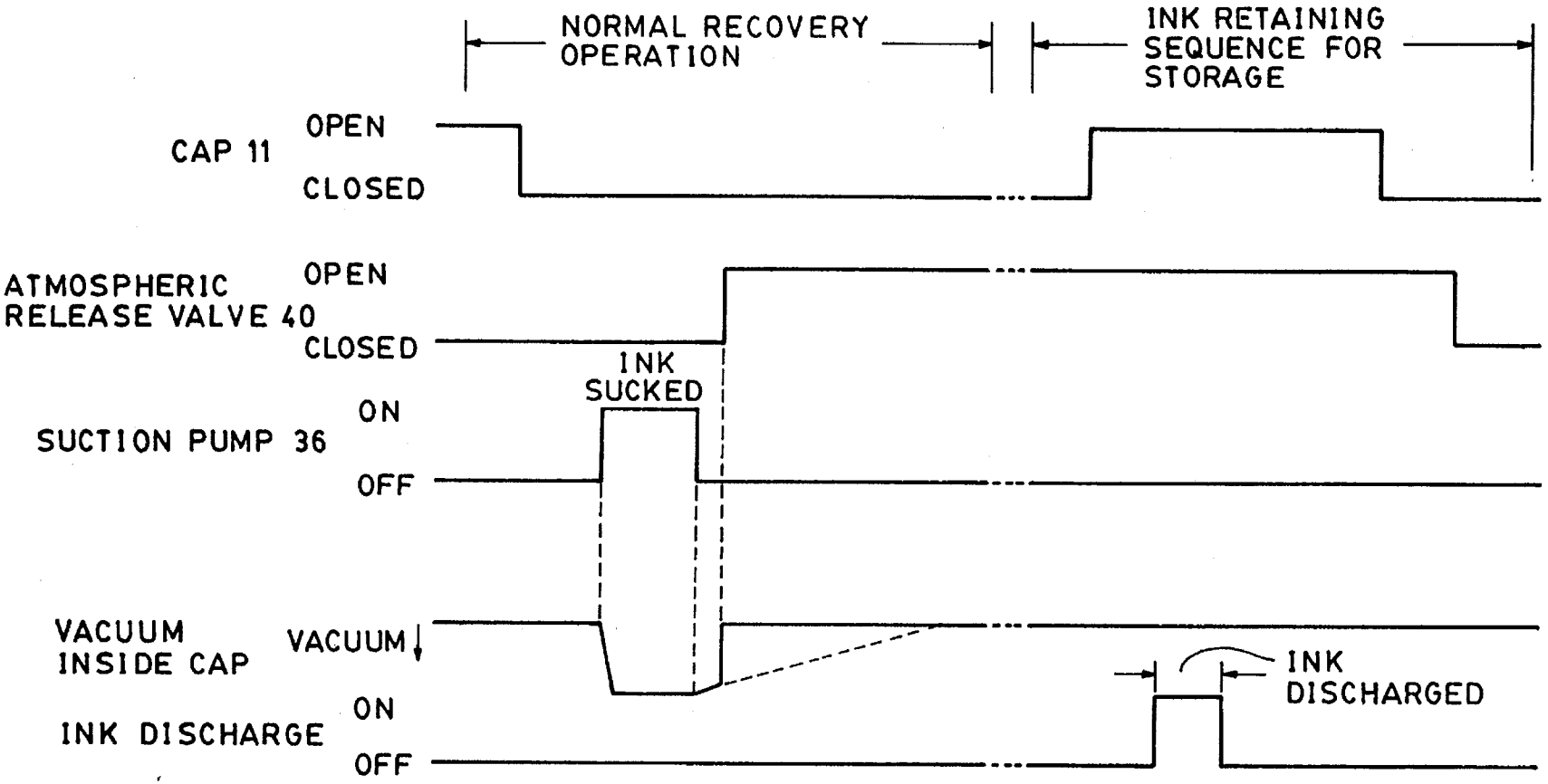
FIG. 5 is a timing chart showing the ink retaining sequence for storage of an ink jet recording apparatus according to an embodiment of the present invention.

FIG. 5 is a timing chart illustrating the sequence of operation when the power is turned off in normal conditions of use of the recording apparatus, after the normal ejection recovery or restoring sequence (ejection restoring operation) has been conducted and a second ink retaining mode of operation for short-time storage is started by a back-up power source. The operation of this ink retaining sequence for storage is substantially the same as the above-described ink retaining sequence for shipment, except for the amount of ink discharged. The ink discharge amount in the ink retaining sequence for storage is determined such that the porous member 35 in the cap 11 retains approximately 25% of its maximum ink retaining capacity.

In the first embodiment, described above, shipment was taken as an example of long-term storage, and the normal condition of use other than shipment was taken as an example of short-term storage. However, the long-term and short-term storage conditions are not restricted to those described above. For example, the short-term storage may be defined as a non-recording period occurring in the normal condition of use, in which the power is on, and the long-term storage may be defined as a power OFF period covering a non-recording period occurring either during shipment or normal conditions of use.

Further, it is also possible to define short-term storage as a period covering both a power ON during normal use and a period from the instant the power is turned off to a fixed point in time. Likewise, it is also possible to define long-term storage as a period after the above-mentioned fixed point in time. In that case, the back-up power source of the apparatus, for example, is utilized to count, by means of a timer, the time elapsing from the instant the power is turned off, thus causing the long-term storage (shipment) sequence to be started when the fixed period of time has elapsed.

As stated above, in the case of long-term storage, an absorptive body lodged in the cap retains an amount of ink corresponding to approximately 80% of its maximum ink retaining capacity, and, in the case of short-term storage, the absorptive body retains an amount of ink corresponding to approximately 25% of its maximum ink retaining capacity. However, the amount of ink to be retained is not restricted to the above. For example, it is desirable that the amount of ink for long-term storage be adjusted within the range of 60 to 90% of the maximum retaining capacity of the absorptive body and the amount for short-term storage be adjusted within the range of 10 to 40% of the same. Taking into account the possible expansion of the ink due to changes in the environmental temperature, it is not desirable to set the amount of ink for long-term storage at 100% of the maximum retaining capacity of the porous body. In this regard, it is more preferable to equip the apparatus with a humidity sensor 41 and vary the ink discharge amount in accordance with the humidity detected by the sensor, thereby appropriately adjusting the amount of ink to be retained by the absorptive body in the cap.

Further, for long-term storage, the above-mentioned timer may be combined with the humidity sensor so as to control the ink discharge such that additional ink is discharged during storage while the cap is closed, so as to moisten the interior of the cap, each time a fixed period has elapsed.

For example, the ink discharge timing can be controlled in such a way that in a high-humidity condition a relatively small amount of ink is discharged at long intervals, whereas, in a low-humidity condition, a relatively large amount of ink is discharged at short intervals. Of course, it is also possible to control the timing in such a way that the ink discharge timing for moistening the interior of the cap is kept constant, with only the ink discharge amount being varied, or, conversely, in such a way that the ink discharge amount is kept constant, with only the discharge timing being varied.

It should be noted that the storage sequences can be executed under various circumstances. For example, the short-term storage sequence can be executed when no recording signal has been input to the recording head for a predetermined time, which means the sequence for short-term storage may be performed utilizing this no-input-recording-signal condition as a trigger.

In the case of long-term storage of the recording head, it is possible, for example, to input and execute a long-term storage sequence before such storage. This would be applicable to special cases like shipment, where it is known that the recording head will remain unused for a long period of time, or in a case where it is expected that the recording head, though ready for recording, will remain unused temporarily but for quite a long period of time, or in a case where the power source is turned off at a main switch.

However, in a case where no recording signal operation has been provided to the elements 25 for a long period of time with the power ON, or in a case where the power has remained OFF longer than a fixed time, a timer or the like may be used to count a fixed period of time, causing a long-term storage sequence to be started the instant the fixed period of time has elapsed.

According to the above-described embodiment, the series of operations described above are conducted using the energy generating elements 25 as introducing means for discharging ink from the recording head 1 into the porous body 35 so that the amount of ink retained by the porous body 35 in the cap 11 may become larger than in the normal condition whenever a storage condition, such as shipment or a power OFF condition, is expected. Due to this arrangement, the interior of the cap 11 is kept in a high-humidity condition for a long period of time, thereby making it possible to mitigate the thickening or clinging of ink due to evaporation of the ink near the ejection nozzles, without adding any special device or component to the recording apparatus. Furthermore, it is possible to keep the amount of ink held within the cap constant. Thus, in accordance with the above-described embodiment, an ink jet recording apparatus is provided which is capable of maintaining a stable ink ejecting condition while preventing the wasteful consumption of ink.

Figure 6:
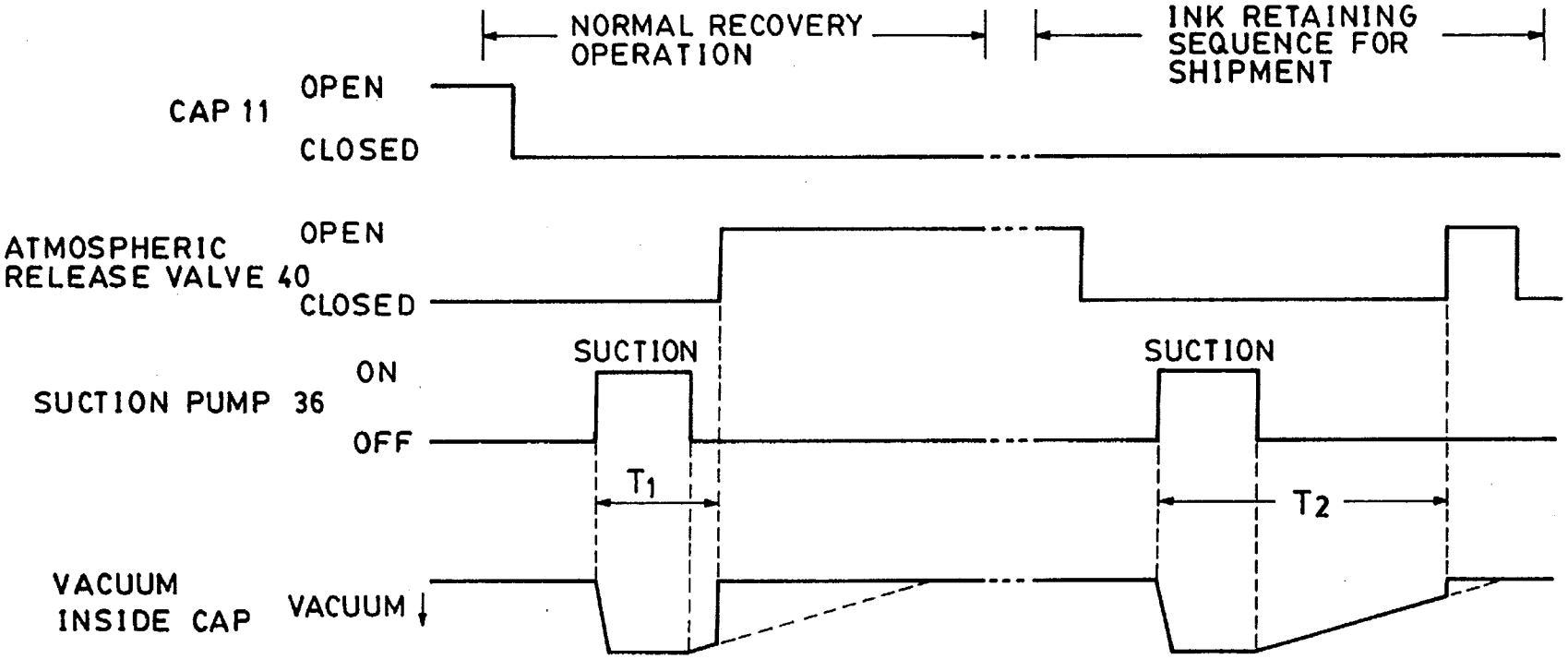
FIG. 6 is a timing chart showing the ink retaining sequence for shipment of an ink jet recording apparatus according to another embodiment of the present invention.
Figure 7:
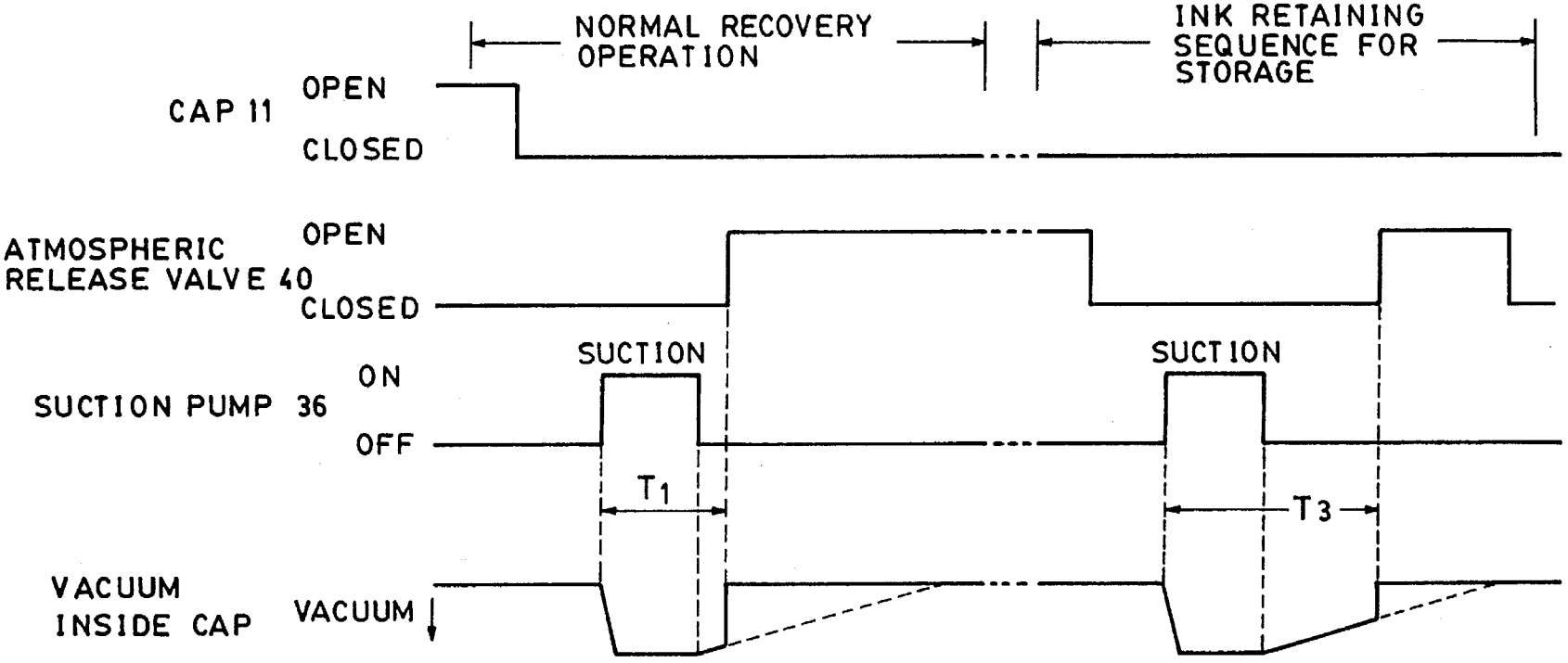
FIG. 7 is a timing chart showing the ink retaining sequence for storage of an ink jet recording apparatus according to another embodiment of the present invention.

Next, an ink jet recording apparatus according to the second embodiment of the present invention will be described. In the above-described first embodiment, the amount of ink retained by the porous body 35 is increased by using the energy generating elements as discharging means to introduce ink from the recording head 1 into the porous body. In this embodiment, the amount of ink retained by the porous body 35 is increased by sucking some ink out of the ejection nozzles 22 by means of a negative pressure source, that is, by using the pump 36 to introduce ink into the porous member 35. Accordingly, this embodiment is also applicable to an ink jet recording apparatus having the construction described with reference to FIGS. 1 to 3. FIG. 6 is a timing chart illustrating the above-described normal ejection restoring sequence and the first ink retaining operation mode for shipment according to this embodiment. FIG. 7 is a timing chart illustrating the above-described normal ejection restoring sequence and the second ink retaining operation mode for storage according to this embodiment.

This embodiment (the second embodiment) will now be described in detail with reference to FIGS. 1 to 3, 6 and 7. As shown in FIG. 3, a porous body 35 excelling in ink retaining capacity is arranged inside the cap 11. When the ejection restoring sequence is started, the same ejection restoring operation is conducted as in the case of the above-described embodiment. That is, a negative pressure is generated by driving the restoring pump (the suction pump) 36, which serves as the negative pressure source, and is introduced into the interior of the cap 11 and to the porous member through the pump pipe 37. The pump pipe 37 is connected to an opening in the rear section of the porous body 35 inside the cap 11. When the restoring pump 36 is driven to generate a negative pressure inside the sealed space defined between the cap 11 and the nozzle surface 21 of the recording head 1, some ink is forcibly sucked out of the ejection nozzles 22 into the cap 11.

The cap 11 is connected to one end of the atmospheric release pipe 39, which communicates with the interior of the cap 11. Connected to the other end of the atmospheric release pipe 39 is an atmospheric release valve 40 which, when opened, allows the interior of the cap 11 to communicate with the ambient atmosphere. The above-mentioned ejection restoring sequence is started with the atmospheric release valve 40 closed, and the valve remains closed in the initial stage of the ink sucking operation. Thus, in the ejection restoring sequence, the atmospheric release valve 40 is opened when a fixed period of time (T1) has elapsed after the start of the ink sucking operation, thereby securing the normal meniscus condition for the ejection nozzles 22 of the recording head 1 and collecting the remaining ink inside the cap 11.

In the case of the ink jet recording apparatus of the second embodiment of the present invention, the ink retaining sequence for shipment is started when the recording apparatus is in the normal condition of use, where the above-described normal ejection restoring sequence (ejection restoring operation) is conducted. When the ink retaining sequence for shipment is started, the following operation is performed. First, the atmospheric release valve 40, which has been in the open position since the completion of the above-described ink sucking operation and atmospheric release, is closed. Then, the suction pump (the restoring pump) 36 is driven by a drive source (not shown) to generate a negative pressure inside the cap 11, thereby sucking some ink from the ejection nozzles 22.

When a preset period T2 has elapsed since the start of the above ink sucking operation, the atmospheric release valve 40 is opened. The preset period T2 in this case is determined such that the initial negative pressure generated by the sucking action of the pump is close to the atmospheric pressure, thus allowing the porous body 35 to retain an amount of ink which is approximately 80% of its maximum retaining capacity. For this purpose, the period T2 between the suction start and the atmospheric release in the ink retaining sequence for shipment is set longer than the period T1 between the suction start and the atmospheric release in the normal ejection restoring sequence described above. Subsequently, the atmospheric release valve 40 is closed, thereby completing the ink retaining sequence for shipment.

FIG. 6 illustrates the second mode of operation, for short-term storage when the power is turned off in the normal conditions of use of the recording apparatus, the ink retaining sequence for storage is started by the back-up power source, from the normal condition, in which the above-described normal ejection restoring sequence (ejection restoring operation) is conducted. The operation of this ink retaining sequence for storage is substantially the same as the above-described ink retaining sequence for shipment, except for the time T3 between the start of the suction by the suction pump 36 and the time the atmospheric release valve 40 is opened. The time T3 between the suction start and the release to the atmosphere in this ink retaining sequence for storage is determined such that the porous body 35 inside the cap 11 retains an amount of ink which is approximately 25% of its maximum retaining capacity. For this purpose, the time T3 between the suction start and the release to the ambient atmosphere in the ink retaining sequence for storage is set longer than the time T1 between the suction start and the release to the ambient atmosphere in the above-described normal ejection restoring sequence and shorter than the time T2 between the suction start and the release to the ambient atmosphere in the above-described ink retaining sequence for shipment.

As in the first embodiment, the parameters of the second embodiment can assume various values according to the purpose. Further, it is possible to effect a more suitable control by adding some predetermined structural features to this embodiment.

In accordance with the second embodiment, described above, a series of operations as described above are conducted when shipping the recording apparatus or when the power to the apparatus is expected to be turned off as in the case of storage, thereby sucking some ink out of the ejection nozzles 22 by the negative pressure source 36 to allow the porous body 35 to retain ink. Further, the time between the suction start and the release to the atmosphere is controlled such that the porous body 35 in the cap 11 is allowed to retain an amount of ink larger than that in the normal condition (the normal condition of use, etc.). Accordingly, the interior of the cap can be kept in a high-humidity condition for a long period of time by a simple method without adding any special devices or components, thus making it possible to mitigate the thickening or clinging of ink due to the evaporation of the ink near the ejection nozzles. Thus, an ink jet recording apparatus has been obtained which is capable of maintaining a stable ink ejection for a long period of time while preventing the wasteful consumption of ink.

While the above-described embodiments have been described as applied to a serial-type ink jet recording apparatus, in which the recording means (the recording head) 1 is mounted on the carriage 2 and in which main scanning is effected along the recording medium, the present invention is also applicable to a line-type recording apparatus, which uses a line-type recording means entirely or partly corresponding to the recording width of the recording medium. The effect obtained in this case is the same as in the above case. Further, while in the above embodiments recording was effected with a single recording head 1, the present invention is also applicable to various types of recording apparatuses irrespective of the number of recording means (recording heads). Thus, the present invention helps to attain the same effect when applied, for example, to a color ink jet recording apparatus which is equipped with a plurality of recording means for recording in different colors, or an ink jet recording apparatus for tone recording which uses a plurality of recording means for recording in inks of the same color but different levels of density.

Further, various types of recording heads can be used as the recording means (the recording head) of the ink jet recording apparatus of this invention. For example, it may be of a head cartridge type which is integrated with an ink tank, or a type which is separate from the ink tank and connected thereto through an ink supply tube or the like. Thus, the present invention can be widely applied irrespective of the structure of the recording head and the ink tank, and helps to attain the same effect as in the above-described cases.

Further, the present invention is applicable to an ink jet recording apparatus which employs a recording means (a recording head) using an electromechanical conversion element or the like, for example, a piezoelectric element. Above all, the present invention provides an excellent effect when applied to a type of ink jet recording apparatus which ejects ink by utilizing heat energy. Such a recording system will help to perform recording at a high level of density and fineness.

The constructions and principles of typical examples of such a recording system are disclosed in U.S. Pat. Nos. 4,723,129 and 4,740,796. It is desirable that the basic principles of these examples be utilized. These systems are applicable to both the so-called on-demand and the continuous types. In the case of the on-demand type, in particular, at least one driving signal, which corresponds to recording information and which is adapted to cause a rapid temperature rise in excess of nucleate boiling, is applied to electrothermal conversion elements arranged in correspondence with liquid (ink) retaining sheets, liquid passages or the like, thereby generating heat energy in the electrothermal conversion elements and causing film boiling on the thermal-action surface of the recording means (the recording head). Thus, when applied to the on-demand type, the present invention is particularly effective since it makes it possible to form a bubble in the liquid (ink) in one-to-one correspondence with this driving signal.

Through the growth and contraction of this bubble, liquid (ink) is ejected to form at least one droplet. When this driving signal has a pulse form, it is possible to effect the growth and contraction of the bubble instantaneously and in an appropriate manner, thus achieving an ejection of liquid (ink) which excels particularly in responsiveness. Suitable examples of this pulse form signal are described in U.S. Pat. Nos. 4,463,359 and 4,345,262. Further, by adopting the conditions described in U.S. Pat. No. 4,313,124, which is related to the rate at which the temperature of the above thermal-action surface rises, it is possible to perform a more improved recording.

Apart from the recording-head constructions disclosed in the above-mentioned patents, in which ejection nozzles, liquid passages and electrothermal conversion elements are combined (the linear-liquid-passage type or the right-angle-liquid-passage type), the present invention embraces a construction in which the section where thermal-action takes place is arranged in a bent area, as disclosed in U.S. Pat. Nos. 4,558,333 and 4,459,600. In addition, the present invention is also effective when applied to the construction disclosed in Japanese Patent Laid-Open No. 59-123670, according to which a common slit is used as the ejecting section of a plurality of electrothermal conversion elements, or a construction disclosed in Japanese Patent Laid-Open No. 59-138461, according to which openings adapted to absorb pressure waves of heat energy are arranged in correspondence with the ejecting sections. Thus, irrespective of the type of the recording head, the present invention makes it possible to record reliably and efficiently.

Further, as indicated above, the present invention can also be effectively applied to a full-line type recording head having a length corresponding to the maximum width of the recording medium that allows the recording apparatus to record. Such a recording head may be either of a type in which the requisite length is obtained by combining a plurality of recording heads, or a type which is formed as an integral recording head unit. Further, the present invention can also be effectively applied to a recording head of the serial type described above, a replaceable-chip-type recording head which, when attached to the apparatus body, allows electrical connection with the apparatus body or ink supply therefrom, or a cartridge-type recording head which is integrated with an ink tank.

Further, it is desirable that the recording apparatus of the present invention may be further equipped with a restoring means for the recording head, a preliminary auxiliary means, etc. since that will help to further stabilize the effect of the present invention. Specifically, a cleaning means, a pressurizing means, electrothermal conversion elements, and heating elements separately provided therefrom, etc. may be combined to provide a preliminary heating means and preliminary discharge mode which is separate from the recording mode, thereby contributing to stable recording.

Further, the type and the number of recording heads mounted may vary according to the intended use of the apparatus. Thus, apart from a single recording head corresponding to a monochrome ink, it is also possible to provide a plurality of recording heads corresponding to different colors or degrees of density, as indicated above. Thus, apart from the recording mode using only a main color, such as black, the present invention can be very effectively applied to an apparatus equipped with a recording head which is capable of at least either a composite color recording using different colors or a full-color recording using mixed colors. In that case, the type of recording head may be one formed as an integral unit or one consisting of a combination of a plurality of heads.

Further, instead of being formed as a terminal unit for image output of an information processing apparatus, such as a computer, the ink jet recording apparatus of the present invention may also be formed as a copying machine combined with a reader or the like, or a facsimile apparatus having a transmitting/receiving function.

As is apparent from the above description, in accordance with the present invention, there is provided an ink jet recording apparatus of the type which records by ejecting ink from a recording means onto a recording medium, the ink jet recording apparatus being controlled in such way that a porous body, which is lodged in a cap for covering the ejection nozzles of the recording means, retains an amount of ink which is relatively large for shipment or long-term storage and relatively small for the normal condition of use. Due to this arrangement, the interior of the cap can be kept in a high-humidity condition for a long period of time, thereby making it possible to mitigate the thickening or clinging of ink as a result of evaporation of some portion of ink near the ejection nozzles. Thus, the ink jet recording apparatus of the present invention is capable of maintaining a stable ink ejection function for a long period of time.

In another aspect of the present invention, the above-mentioned porous body can retain ink ejected onto it from the recording means. Due to this arrangement, it is possible to provide an ink jet recording apparatus which can attain the above effect without being equipped with any special devices or components and in which the porous body can easily retain an amount of ink which is larger than that in the normal conditions of use.

What is claimed is:

1. An ink jet apparatus comprising:

a cap member for sealing an ejection nozzle of a recording head for varying duration non-recording periods during which ink is not ejected from the ejection nozzle for recording, wherein said cap member has disposed in the interior thereof a body for retaining ink;

introducing means for introducing ink to said body for retention thereby of variable amounts of ink during different non-recording periods; and control means for operating said introducing means to introduce ink to said body, wherein said control means controls an amount of ink retained by said body in accordance with a duration of each of the different non-recording periods to follow operation of said introducing means.

2. An ink jet apparatus according to claim 1, wherein said control means operates said introducing means to introduce a predetermined amount of ink to said body when an ink jet printer incorporating the apparatus is being prepared for shipment.

3. An ink jet apparatus according to claim 1, wherein said control means operates said introducing means to introduce a predetermined amount of ink to said body when a continuous non-recording period lasts longer than fixed period of time.

4. An ink jet apparatus according to claim 1, wherein said introducing means includes discharging means for providing ink discharge from the ejection nozzle to said body for a predetermined period of time, said control means operating said introducing means in a first mode for preparing for shipment an ink jet printer incorporating the apparatus and a second mode for preparing the ink jet printer for a short-term storage period, wherein the predetermined period of time is longer in the first mode than in the second mode.

5. An ink jet apparatus according to claim 4, further comprising means for moving said cap member into and out of sealing contact with a surface having the ejection nozzle therein, wherein said control means operates said discharging means when said cap member is out of contact with the surface and thereafter moves said cap member into contact with the surface.

6. An ink jet apparatus according to claim 5, further comprising atmosphere communicating means for selectively communicating the interior of said cap member to ambient atmosphere.

7. An ink jet apparatus according to claim 6, wherein said atmosphere communicating means includes an atmospheric release valve for opening and closing said cap member to the ambient atmosphere and said control means controls said atmospheric release valve to close said cap member after said cap member is moved into sealing contact with the surface.

8. An ink jet apparatus according to claim 4, wherein said discharging means comprises an energy generating element for discharging ink from the ejection nozzle toward a recording medium to effect recording thereon.

9. An ink jet apparatus according to claim 1, wherein said introducing means includes suction means for sucking ink through the ejection nozzle and into said cap member for retention by said body.

10. An ink jet apparatus according to claim 9, further comprising means for moving said cap member into and out of sealing contact with surface having the ejection nozzle therein, wherein said control means operates said suction means when said cap member is in contact with the surface.

11. An ink jet apparatus according to claim 10, further comprising atmosphere communicating means for selectively communicating the interior of said cap member to ambient atmosphere.

12. An ink jet apparatus according to claim 11, wherein said atmosphere communicating means includes an atmospheric release valve for opening and closing said cap member to the ambient atmosphere and said control means controls said atmospheric release valve to close said atmosphere communicating means while said suction means is operating.

13. An ink jet apparatus according to claim 11, wherein said control means opens said atmospheric release valve a predetermined time period after operation of said suction means is initiated and thereafter closes said atmospheric release valve.

14. An ink jet apparatus according to claim 13, wherein said predetermined time period is longer in a first mode for preparing for shipment an ink jet printer incorporating the apparatus than in a second mode for preparing the ink jet printer for a short-term period.

15. An ink jet apparatus according to claim 10, wherein said suction means comprises a suction pump connected to the interior of said cap member.

16. An ink jet recording apparatus comprising:

a recording head having a surface with ejection nozzles for discharging ink:

a cap member for contacting and sealing said surface of said recording head, wherein said cap member has disposed in the interior thereof a porous body for retaining ink;

introducing means for introducing ink to said porous body for retention thereby;

control means for operating said introducing means to introduce ink to said porous body to increase the humidity in the interior of said cap member when said surface is sealed, wherein said control means operates said introducing means in a first mode in which a first predetermined amount of ink is introduced to said porous body for storage of the apparatus for a non-recording period of a first duration, and in a second mode in which a second, smaller predetermined amount of ink is introduced to said porous body for storage of the apparatus for a non-recording period of a second, shorter duration; and a humidity sensor connected to said control means for sensing the humidity of the interior of said cap member when said surface is sealed, wherein said control means operates said introducing means in accordance with the humidity sensed by said humidity sensor to maintain within a predetermined range the amount of ink retained by said porous body.

17. An ink jet recording apparatus according to claim 16, wherein the amount of ink retained by said porous body during the longer non-recording period is maintained in the range of 60% to 90%, and preferably at about 80%, of the maximum ink retaining capacity of said porous body.

18. An ink jet recording apparatus according to claim 16, wherein the amount of ink retained by said porous body during the shorter non-recording period is maintained in the range of 10% to 40%, and preferably at about 25%, of the maximum ink retaining capacity of said porous body.

19. An ink jet apparatus according to claim 1, further comprising ink jet recording means having an electrothermal conversion element for generating heat energy for discharging ink.

20. An ink jet apparatus according to claim 19, wherein said electrothermal conversion element applies heat energy to the ink to cause film boiling thereof.

21. An ink jet apparatus according to claim 1, wherein said control means operates said introducing means to introduce ink to said body only after a non-recording period of a predetermined duration.

22. An ink jet apparatus according to claim 1, wherein said control means includes a timer for operating said introducing means to introduce ink to said body during the non-recording period.

23. An ink jet apparatus according to claim 1, wherein the amount of ink introduced to said body before the non-recording period is greater when the non-recording period is expected to be longer.

24. An ink jet apparatus according to claim 1, wherein the amount of ink introduced to said body at each operation of said introducing means is constant, the amount of ink retained by said body during the non-recording period being varied by changing the number of times said introducing means is operated.

25. A method of preserving an ejection condition of a recording head with an ejection nozzle for ejecting ink for recording, the method comprising the steps of:

providing a cap member having disposed in the interior thereof a body for retaining ink;

sealing the ejection nozzle with said cap member for a non-recording period during which ink is not ejected from the ejection nozzle for recording; and introducing ink to said body for retention thereby during the non-recording period, wherein an amount of ink retained by said body is controlled in accordance with a duration of the non-recording period to follow the introduction of ink to said body.

26. A method according to claim 25, wherein said introducing step includes ejecting ink from the ejection nozzle and said sealing step is performed after said introducing step.

27. A method according to claim 25, wherein said introducing step is performed after said sealing step and includes drawing ink from the ejection nozzle by applying suction to the interior of said cap member.

28. A method according to claim 25, wherein said introducing step is performed after lapse of predetermined time after said sealing step.

29. A method according to claim 25, wherein said introducing step is repeated at least once during the non-recording period following initial performance of said introducing step.

* * * * *

UNITED STATES PATENT AND TRADEMARK OFFICE

CERTIFICATE OF CORRECTION

PATENT NO. : 5,483,266

DATED : January 9, 1996

INVENTOR(S) : FUMIHARU NAKAMURA

It is certified that error appears in the above-indentified patent and that said Letters Patent is hereby corrected as shown below:

COLUMN 2

Line 19, "ink-ejection-energy" should read --ink-ejection energy--.

COLUMN 9

Lines 15, 17 and 22, "T2" should read --$T_2$--;

line 25, "T1" should read --$T_1$--;

lines 38, 40 and 45, "T3" should read --$T_3$--;

line 47, "T1" should read --$T_1$--.

line 50, "T2" should read --$T_2$--.

COLUMN 11

Line 17, "thermal-action" should read --thermal action--.

UNITED STATES PATENT AND TRADEMARK OFFICE

CERTIFICATE OF CORRECTION

PATENT NO. : 5,483,266

DATED : January 9, 199695

INVENTOR(S) : FUMIHARU NAKAMURA

It is certified that error appears in the above-indentified patent and that said Letters Patent is hereby corrected as shown below:

COLUMN 13

Line 28, "surface" should read --a surface--.

Signed and Sealed this

Eleventh Day of June, 1996

Bruce Lehman

*Attest:*

BRUCE LEHMAN

*Attesting Officer*

*Commissioner of Patents and Trademarks*